US009316008B2

(12) United States Patent
Poldmaa

(10) Patent No.: US 9,316,008 B2
(45) Date of Patent: Apr. 19, 2016

(54) ROOF ANCHOR WITH SHOCK ABSORBING MEANS

(75) Inventor: Arvo Poldmaa, Hawks Nest (AU)

(73) Assignee: H2Flo Pty Ltd, Hawks Nest, New South Wales (AU)

( * ) Notice: Subject to any disclaimer, the term of this patent is extended or adjusted under 35 U.S.C. 154(b) by 1493 days.

(21) Appl. No.: 13/990,675

(22) PCT Filed: Jul. 3, 2009

(86) PCT No.: PCT/AU2009/000862
§ 371 (c)(1),
(2), (4) Date: Jul. 10, 2013

(87) PCT Pub. No.: WO2010/000035
PCT Pub. Date: Jan. 7, 2010

(65) Prior Publication Data

US 2013/0277519 A1 Oct. 24, 2013

(30) Foreign Application Priority Data

Jul. 3, 2008 (AU) ..... 2008903413

(51) Int. Cl.
*A62B 35/04* (2006.01)
*E04G 21/32* (2006.01)
(Continued)

(52) U.S. Cl.
CPC ..... *E04G 21/328* (2013.01); *A62B 1/04* (2013.01); *A62B 35/0068* (2013.01); *A62B 35/04* (2013.01); *E04G 21/3261* (2013.01)

(58) Field of Classification Search
USPC ..... 248/560, 562, 566, 617; 52/24, 25, 26, 52/27, 749.12, 698, 167.1, 712, 714, 167.7
See application file for complete search history.

(56) References Cited

U.S. PATENT DOCUMENTS 3,444,957 A 5/1969 Gilpin
3,812,535 A * 5/1974 Higgins et al. ..... 360/244.2
(Continued)

FOREIGN PATENT DOCUMENTS

AU 2008100234 A4 3/2008
AU 2009210368 A1 * 3/2010 ..... E04D 13/12
(Continued)

OTHER PUBLICATIONS

PCT International Search Report, PCT/AU2009/008623, dated Sep. 8, 2009.
(Continued)

*Primary Examiner* — Alfred J Wujciak
(74) *Attorney, Agent, or Firm* — TraskBritt, P.C.

(57) ABSTRACT

Described is a multi-directional roof anchor. The anchor is shaped so as to progressively distort under sudden load. The anchor has a generally planar structure, in which a first fixing region for fitment, either directly or indirectly, to a roofing material is provided. The anchor also includes a second attachment region for attaching devices, apparatus or equipment to the anchor, and a third shock absorbing region provided between, and integral with, the first and second regions. The third region includes one or more shock absorbing portions, shaped so as to provide gradual or progressive absorption of a sudden load applied to the anchor. The absorption is provided either by the third region alone or the third region in combination with one or both of the other two regions. Advantageously, the anchor has the ability to absorb such load when applied to it from any direction.

14 Claims, 4 Drawing Sheets

(51) Int. Cl.
*A62B 1/04* (2006.01)
*A62B 35/00* (2006.01)

(56) References Cited

U.S. PATENT DOCUMENTS

| | | | | |
|---|---|---|---|---|
| 5,113,981 | A | 5/1992 | Lantz | |
| 5,174,410 | A | 12/1992 | Casebolt | |
| 6,085,802 | A | 7/2000 | Silberberg | |
| 6,098,746 | A * | 8/2000 | Castaneda | 182/45 |
| 7,665,248 | B2 | 2/2010 | Blackford | |
| 9,021,749 | B2 | 5/2015 | Poldmaa | |
| 2013/0056608 | A1 | 3/2013 | Poldmaa | |
| 2013/0168528 | A1 * | 7/2013 | Patton et al. | 248/548 |
| 2014/0346314 | A1 | 11/2014 | Poldmaa | |

FOREIGN PATENT DOCUMENTS

| | | | |
|---|---|---|---|
| AU | 2012216652 | A1 | 9/2011 |
| CA | 2157947 | A1 | 4/1996 |
| EP | 1762275 | | 3/2007 |
| FR | 2857601 | | 1/2005 |
| GB | 964096 | | 7/1964 |
| GB | 1536354 | | 12/1978 |
| GB | 2 084 691 | A | 4/1982 |
| GB | 2330169 | A | 4/1999 |
| GB | 2 396 195 | A | 6/2004 |
| GB | 2426563 | A | 11/2006 |
| NZ | 238211 | | 10/1993 |
| NZ | 590186 | | 3/2012 |
| WO | 9529738 | | 11/1995 |
| WO | 9737876 | | 10/1997 |
| WO | 0146601 | | 6/2001 |
| WO | WO 03047700 | | 6/2003 |
| WO | WO 2010/000035 | A1 | 1/2010 |

OTHER PUBLICATIONS

Patent Examination Report No. 3 from Australian Patent Office for Australian Patent Application No. 2012216652. dated May 14, 2015.
PCT International Search Report, PCT/AU2009/00862, dated Sep. 8, 2009.

* cited by examiner

ROOF ANCHOR WITH SHOCK ABSORBING MEANS

TECHNICAL FIELD

The present invention relates to a roof anchor for attaching devices, apparatus or equipment to a roof surface and, more particularly, to an anchor point for fixing directly to a metal roof which includes shock absorbing means. The devices, apparatus or equipment to be attached may include safety equipment such as a safety harnesses, ropes or other safety devices adapted to secure a roof worker against falling and injury.

BACKGROUND ART

Conventional roof anchoring devices require access to the roof support structure such as a purlin or rafter. Direct access to the support structure is generally required and involves mounting the roof anchor prior to the application of the external covering of the roof such as tiles, sarking, sheeting or other cladding so that upon application of the external covering to the support structure, the roof anchor extends proud of the external covering.

However, lithe external covering has already been applied to the roof support structure, then at least one unit of the external covering such as a tile or single sheet of covering must be removed to provide access to the roof support structure. Where part of the external covering must be removed to provide access to the roof support structure, such as for example will be the case for a completed building to which repairs, improvements or renovations are required, this may be impractical or inconvenient. Thus, for example, where large units of sheeting form the external covering of the roof, considerable time and effort may have to be expended to remove a single unit to gain access to the roof support structure. Furthermore, there is also a risk that damage to the covering may occur, or more particularly, once it is re-laid, the covering might not properly seal against the elements.

It would therefore be advantageous if a roof anchor were available which could be affixed directly to the roofing material, with or without affixing as well to a purlin or rafter supporting the roofing material. It would also be advantageous if such a roof anchor was provided with shock absorbing means in order to minimise injury from a person utilising the anchor point and reduce the load on the structure in the event of a fall. Further, it would also be desirable if the anchor point were multi-directional so that it worked efficiently no matter from which direction forces might be applied in the event of a fall.

OBJECT OF THE INVENTION

It is an object of the present invention to provide a roof anchor which ameliorates one or more of the abovementioned disadvantages associated with the prior art, particularly by providing an anchor point which may be mounted directly to the roofing material, the anchor being so shaped as to progressively absorb the effects of a sudden load applied thereto, and wherein the anchor functions usefully in all directions.

It should also be understood that whilst the invention relates primarily to the attachment of devices to a roof as described, the invention will also be applicable in many instances where attachment of a device to another surface or structure is required, whether a wall or ceiling for example. Thus any reference to a roof is also meant to encompass reference to any structure, where, by suitable adaptation the invention may also be utilised.

DISCLOSURE OF THE INVENTION

According to the present invention, there is provided a multi-directional roof anchor for fitment to a roofing material affixed to a building, wherein the anchor is shaped so as to progressively distort under sudden load, the anchor having a generally planar structure, having a first fixing region or regions for fitment to a roofing material, with means provided therein by which the anchor can be affixed either directly to the roofing material, or through the roofing material, to the supporting structure below; a second attachment region for attaching devices, apparatus or equipment to the anchor; and a third shock absorbing region intermediate between the first and second regions and integral therewith, the third region comprising one or more shock absorbing portions, shaped so as to provide gradual or progressive absorption of a sudden load applied to the anchor as would occur in the event of a fall of a person attached thereto, the absorption provided either by the third region alone or the third region in combination with one or both of the other two regions, the anchor further having the ability to absorb such load when applied to it from any direction.

Preferably, the roof anchor point is die cut from a single sheet of stainless steel, aluminium, high density plastics material or composite material and cut so as to provide progressive absorption of a sudden load applied thereto by means of progressive deformation under such load.

Preferably the shock absorption is provided by one or more suitably shaped portions of material cut or otherwise formed so that when a force is applied thereto, there is created a deformation therein in the form of a generally linear extension of that portion, ie by effectively straightening or "unbending" such region. Thus the anchor is so designed that deformation by bending, ie unbending or straightening, of the third shock absorbing region together with such other of the first or second regions where appropriate, provides an absorption of the forces applied to the anchor from any angle, that is to say if a load is exerted from any direction, the anchor is able to accommodate that sudden load by bending in suitable fashion. In this way the anchor will provide a suitable shock absorber means against for example a sudden load arising from a person attached thereto falling from the roof.

Preferably the means for attaching the first region to a roof material is provided by holes located in the first region. Thus, fitment of the anchor utilising the first region either directly to the roofing material or through the roofing material to the supporting structure may be achieved by any suitable means such as rivets, bolts or screws and may be achieved by fixing the anchor point solely to the roofing material or fixing through the roofing material so that the anchor point is also affixed to the roofing structure which supports the roofing material.

Preferably the first fixing region is a single substantially linear region having a plurality of holes therethrough in linear arrangement so that the anchor may be affixed along one ridge of a metal roof profile. Alternatively, the first fixing region may be provided by a pair of substantially parallel linear regions spaced apart so as to span a trough in a roof profile, the regions being fixable to adjacent ridges in the roof profile. Preferably, the roof anchor is provided with upwards of 5, 6, 7 or more holes to allow secure fitment to the ridge or ridges of the roof sheeting. The number of holes is determined by the thickness of the roofing material.

In a first embodiment of the invention, preferably there are provided two shock absorbing portions located on either side of a single central first fixing region, whilst in a second embodiment of the invention, preferably there are provided two shock absorbing portions extending between two outer fixing regions. In either embodiment the two absorbing portions remote from the one or two fixing regions as the case may be terminate at a single third attachment region.

Preferably the attachment region is provided with a hole therethrough for attaching devices, apparatus or equipment in known fashion. Alternatively the attachment means is provided by a loop or bridge between the pair of absorbing regions.

Preferably, there is provided in any of the embodiments one or more breakable joins or connections between the first fixing and second attachment regions, which are designed to prevent the anchor from simply bending under initial load, but fails at a pre-determined load, whereby the load is then essentially exerted on the absorbing section(s) progressively.

It will be understood from the embodiments described herein, that the design is able to function irrespective of the direction of the load.

BRIEF DESCRIPTION OF THE DRAWINGS

The invention will be better understood from the following non-limiting description of various embodiments of the present invention with reference to the drawings in which.

DETAILED DESCRIPTION OF THE DRAWINGS

Figure 1:
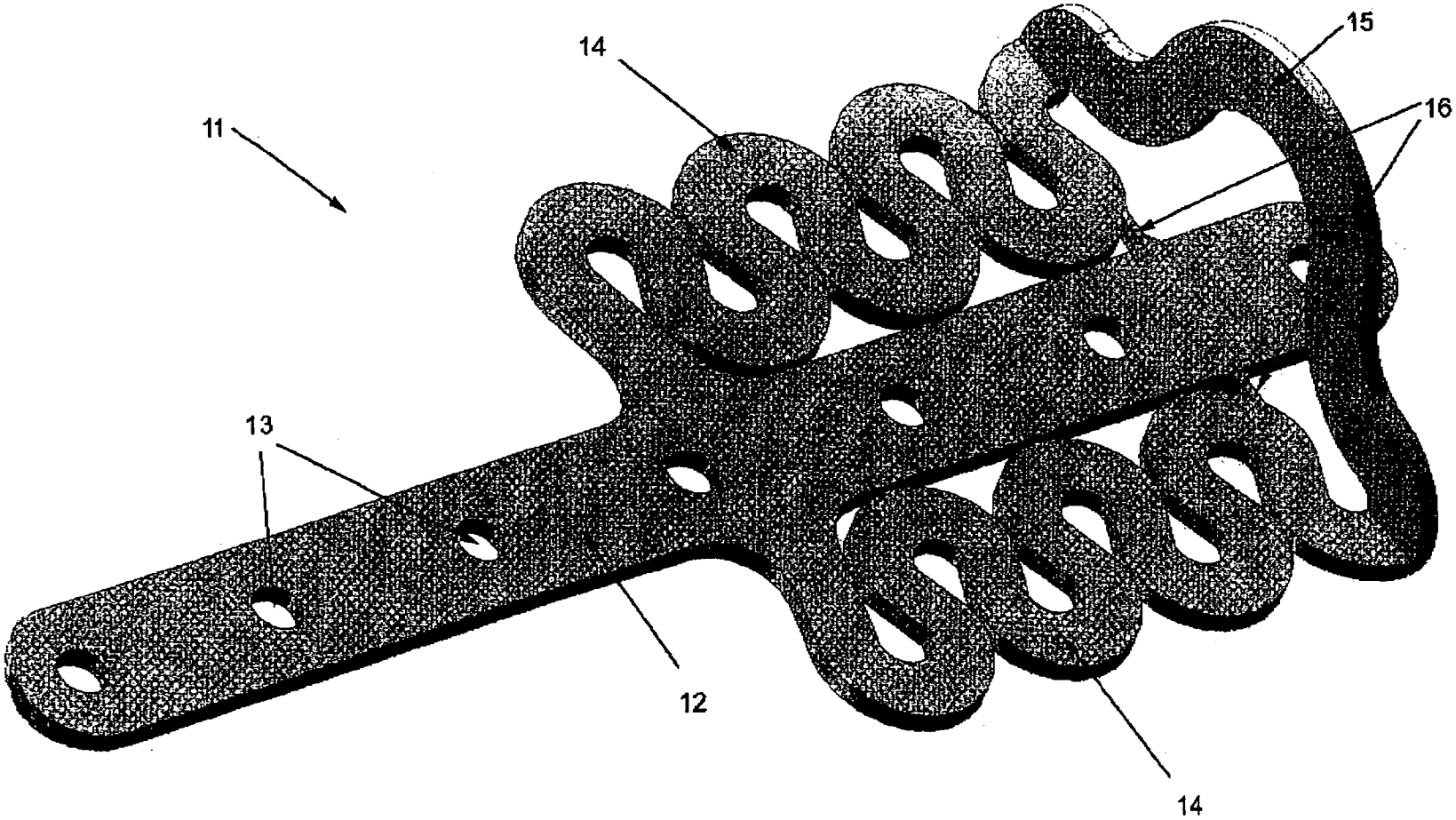
FIG. 1 is a perspective view of a roof anchor according to one embodiment of the invention, with one end region bent.
Figure 2:
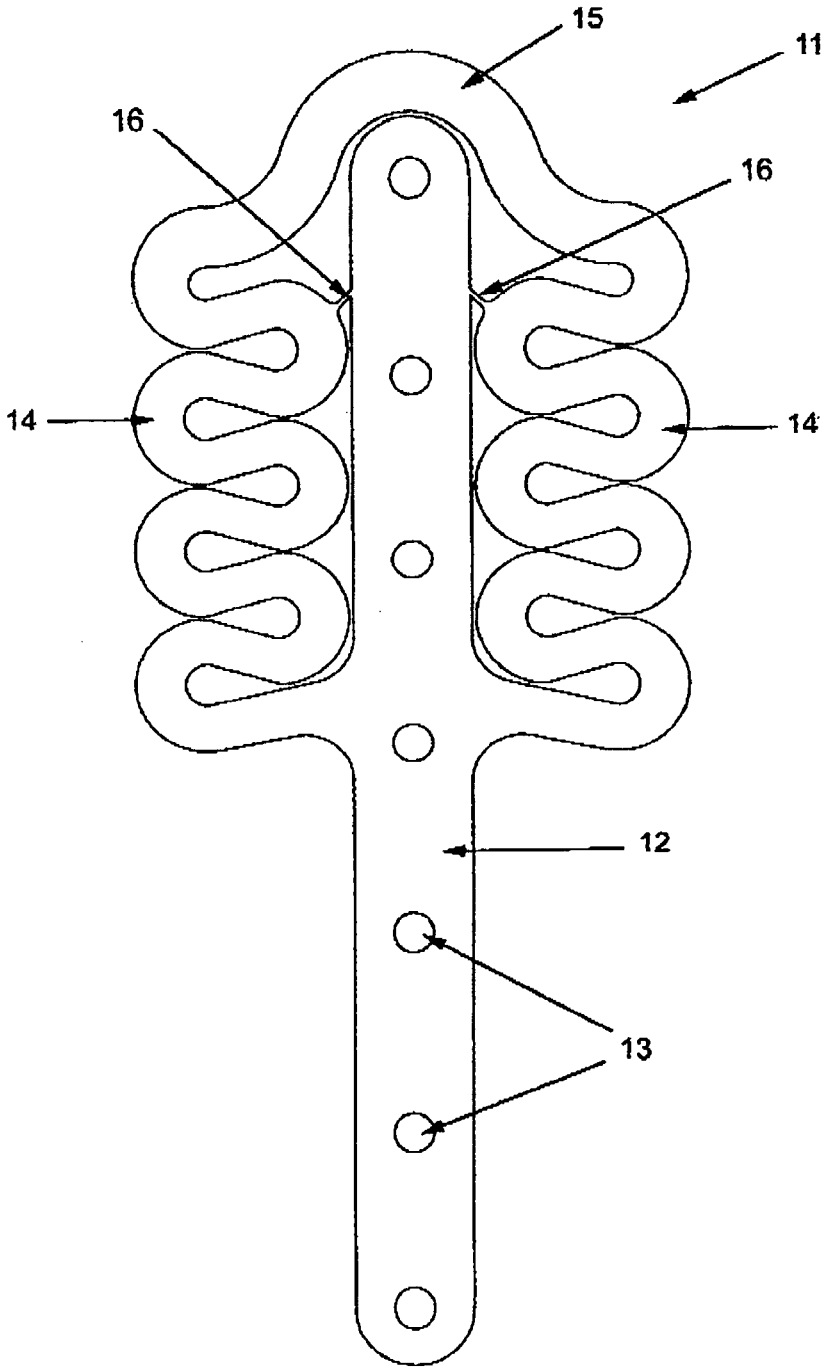
FIG. 2 is a plan view of the roof anchor shown in FIG. 1 before bending.

Referring generally to FIGS. 1 and 2, there is shown a roof anchor generally referenced 11 according to a first embodiment of the invention. The roof anchor 11 is made from a single sheet of stainless steel material 3 mm thick, die cut as shown.

The anchor comprises a central portion 12 for affixing along the length of a rib in a sheet of roofing material (not shown). This central fixing portion 12 is provided with several holes 13, in this case seven, along its length through which suitable fastening means are employed, eg special rivets which can't be over-tightened, in order to affix the roof anchor 11 to the ridge or rib of the sheeting material.

Extending laterally on either side of the central fixing portion 12 are two snake like regions designed to act as shock absorbers 14 when a load is applied to the anchor 11, as would occur in a fall of a person attached thereto.

One end of each shock absorber region 14 extends from an area roughly half way along the central fixing portion 12 and the other ends thereof respectively terminate in a bridge portion 15 extending therebetween which provides an attachment region to which a cable, safety harness, rope etc (not shown) may be attached. As shown in FIG. 1, this attachment bridge portion 15 is conveniently bent upwards at a right angle to the plane of the rest of the anchor 11, but in practice this is not necessary and any convenient angle may be chosen, or the bridge 15 not bent at all.

In the vicinity of the region where each shock absorbing portion 14 becomes the bridge region 15, there are provided small spanning joins 16 extending between that part of the shock absorber 14 and the nearest point on the fixing portion 12, the purpose of which is to provide break points so that the initial load applied to the anchor 11 should a fall be experienced, does not cause the shock absorbing regions 14 to come into play until a predetermined initial load has been experienced. In this way initial unwanted bending of the anchor 11 at a single point is avoided.

It will also be appreciated that no matter from which direction a load is applied to the anchor 11, ie no matter which direction a person falls who is attached thereto, the anchor 11 will still function effectively, the shock absorbers 14 on either side sharing to a greater or lesser degree the load and suitably deforming depending on the direction of the load. Even if the load is experienced from the end of the anchor 11 opposite that of the attachment region 15, the anchor 11 will still work effectively, the initial load breaking the joins 16 at a predetermined load level and then the shock absorbing regions 14 being only then bent back but otherwise then extending at the same time to absorb the load.

Thus when a load is applied to a cable or rope etc attached to the attachment region 15 of the anchor 11, it causes the break points 16 to give way at a predetermined load, and then the shock absorbing regions 14 progressively bend (ie extend or appear to unbend), so that the load is absorbed more slowly, thereby reducing the risk of injury from someone having fallen.

Figure 3:
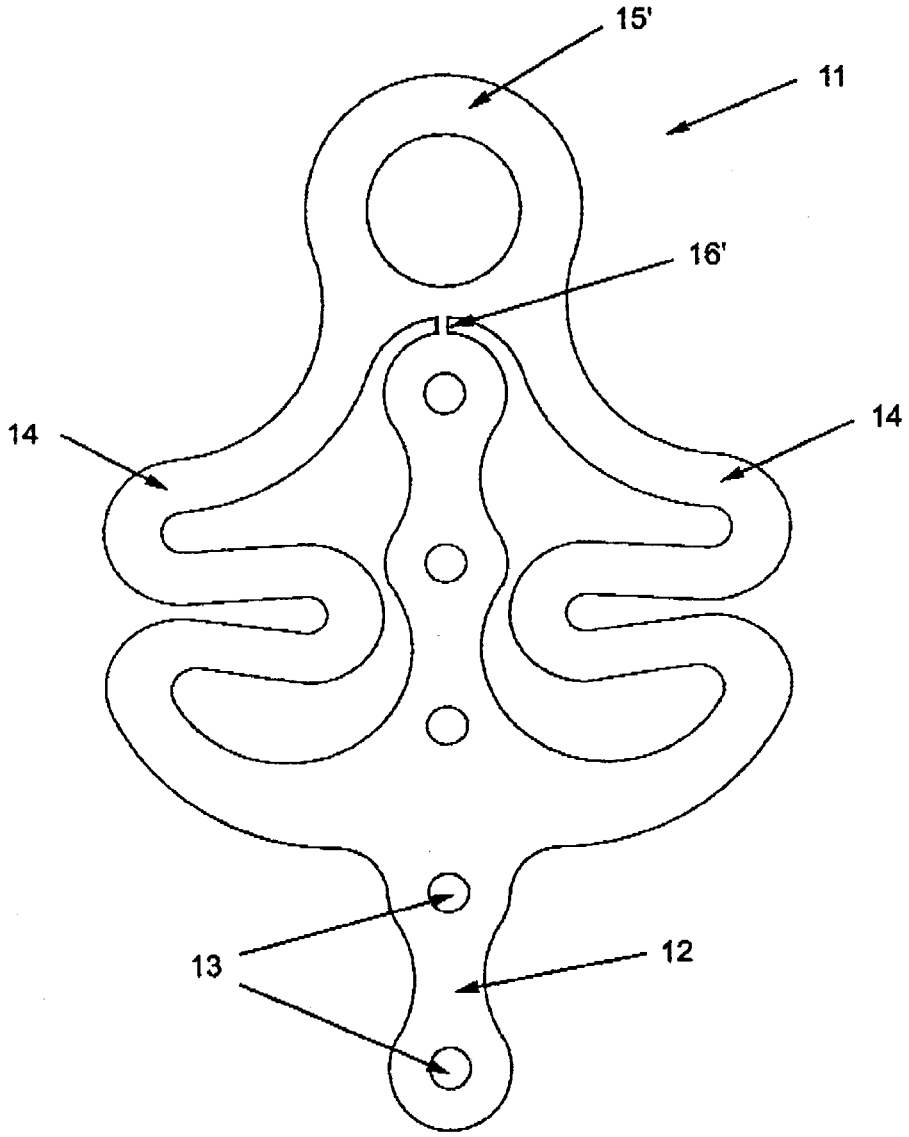
FIG. 3 is a plan view of a roof anchor according to a second embodiment of the invention.
Figure 4:
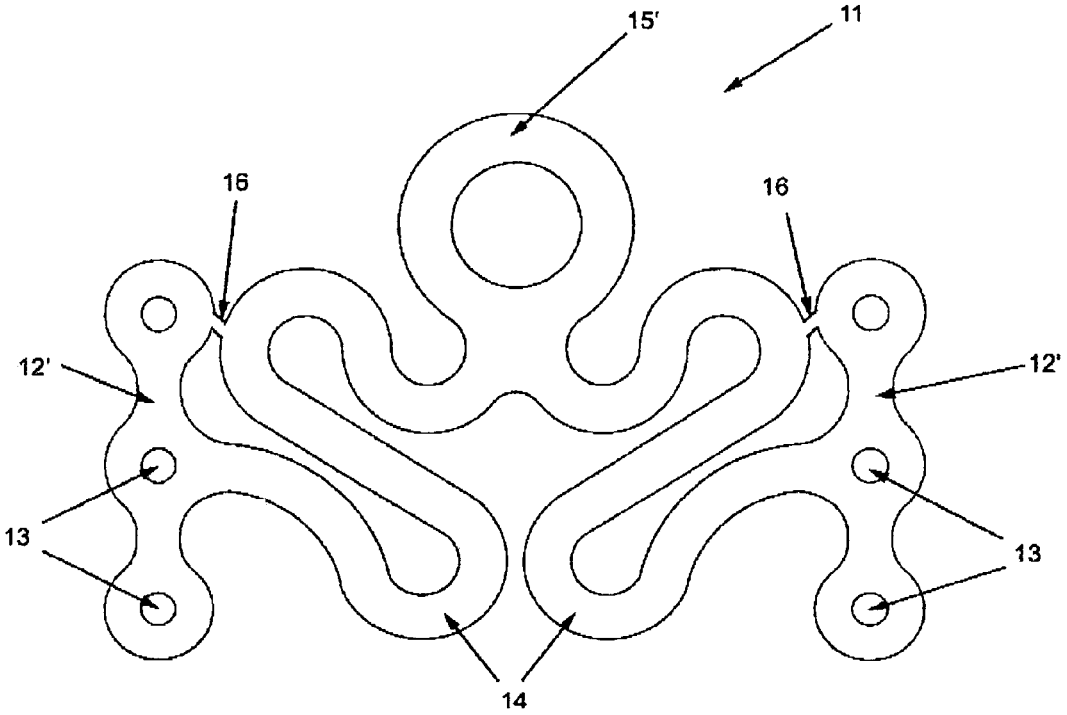
FIG. 4 is a plan view of a roof anchor according to a third embodiment of the invention.

Referring generally to FIGS. 3 and 4, there are shown two additional embodiments of a roof anchor 11 according to the invention, in which like components are referenced with the same numerals for ease of comparison.

The embodiment in FIG. 3, is generally similar in structure to that of the embodiment in FIGS. 1 and 2, having a central fixing portion 12 and two shock absorbing regions 14 extending either side thereof. Again they commence about mid way along the fixing portion 12 but instead of terminating at the other end in a bridge region, they join together at a generally ring like portion 15' which acts as an attachment point, in the same as the bridge portion 15 of the earlier embodiment functions. Further, instead of two join points 16 as shown earlier, here the roof anchor of FIG. 3 is provided with one point 16' only.

The overall function of the roof anchor 11 in this embodiment is otherwise similar to that described above for the first embodiment.

The third embodiment of a roof anchor 11 as shown in FIG. 4 is different in so far as it is provided with a pair of generally parallel fixing portions 12' which are able to span the valley of a roof sheeting material, so that each fixing portion 12' may be affixed to consecutive ridges of the sheeting material (not shown). Instead of extending outwardly from a central fixing portion 12' as in the earlier embodiments, this embodiment again has two shock absorbing regions 14 but this time they extend inwardly of each of the two fixing portions 12'. Again they extend from the fixing portions 12' roughly mid way along their lengths, and again terminate in an attachment ring 15' in similar fashion to that of the second embodiment.

In this case, two join points 16 are again provided as shown, conveniently located so as to connect the shock absorbing regions 14 to the ends of the fixing portions 12' in similar fashion to that described for the first embodiment.

Again, although this structure is inherently different from those of the first and second embodiments, at least visually, it will be appreciated to those skilled in the art, that in essence, the third embodiment functions in like fashion to the other embodiments.

It will appreciated that many modifications and variations may be made to the embodiments described herein by those skilled in the art without departing from the spirit or scope of the invention.

Throughout the specification and claims the word "comprise" and its derivatives are intended to have an inclusive rather than exclusive meaning unless the context requires otherwise.

INDUSTRIAL APPLICABILITY

It will be immediately apparent to persons skilled in the art that the roof anchor may provide an anchor point for a variety of activities carried out on roofs. For example, the roof anchor may provide an anchor point for posts supporting fences or other barriers erected for the safety of workmen working on the roof or may be used to secure equipment associated with the actual work on the roof. Moreover, the roof anchor may provide an anchor point for fittings such as solar panels or water heaters required to be mounted on the roof.

The invention claimed is:

1. A multi-directional roof anchor for fitment to a roofing material affixed to a building, wherein the anchor is shaped so as to progressively distort under sudden load, the anchor having a generally planar structure, having a first fixing region for fitment to a roofing material, the first fixing region being configured to facilitate fixing of the anchor either directly to the roofing material, or through the roofing material, to a roof support below, and wherein the first fixing region is attached to a roof material by providing holes located in the first fixing region; a second attachment region for attaching devices, apparatus or equipment to the anchor; and a third shock absorbing region intermediate between the first and second regions and integral therewith, the third region comprising at least one shock absorbing portion, shaped so as to provide gradual or progressive absorption of a sudden load applied to the anchor as would occur in the event of a fall of a person attached thereto, the absorption provided either by the third region alone or the third region in combination with one or both of the other two regions, the anchor further having the ability to absorb such load when applied to it from any direction, wherein the anchor comprises one or more joins or connections between the first fixing region and the second attachment region.

2. A multi-directional roof anchor according to claim 1, wherein the anchor is attached to the roof material by rivets, bolts or screws affixed through the holes in first fixing region either directly into the roofing material or through the roofing material to the roof support which supports the roofing material.

3. A multi-directional roof anchor according to claim 1, wherein the first fixing region is a single substantially linear region having a plurality of holes therethrough in linear arrangement so that the anchor may be affixed along one ridge of a metal roof profile.

4. A multi-directional roof anchor according to claim 1, wherein the first fixing region comprises a pair of substantially parallel linear regions spaced apart so as to span a trough in a roof profile, the pair of linear regions being fixable to adjacent ridges in the roof profile.

5. A multi-directional roof anchor according to claim 1, wherein the roof anchor is provided with 5 or more holes to allow secure fitment to the ridge or ridges of the roof sheeting.

6. A multi-directional roof anchor according to claim 1, wherein the first fixing region comprises a single central first fixing region and the third region comprises two shock absorbing portions located on either side of the single central first fixing region.

7. A multi-directional roof anchor according to claim 6, wherein the two shock absorbing portions are remote from the first fixing region and teiminate at the single second attachment region.

8. A multi-directional roof anchor according to claim 6, wherein the attachment region comprises a bridge extending between the pair of shock absorbing portions.

9. A multi-directional roof anchor according to claim 1, wherein the first fixing region comprises two outer fixing regions and the third region comprises two shock absorbing portions extending between the two outer fixing regions.

10. A multi-directional roof anchor according to claim 1, wherein the attachment region defines a hole therethrough for attaching a device or devices, apparatus or equipment.

11. A multi-directional roof anchor according to claim 1, wherein the one or more joins or connections are designed to prevent the anchor from simply bending under initial load, but which fail at a predetermined load, whereby the load is then essentially exerted progressively on the absorbing section or sections as the case may be.

12. A multi-directional roof anchor according to claim 1, wherein the one or more joins or connections comprises at least one small spanning join extending between the shock absorbing portion and a near point on the first fixing region.

13. The multi-directional roof anchor of claim 1, wherein the anchor is die cut from a single sheet of stainless steel, aluminum, high density plastics material or composite material and cut so as to provide progressive absorption of a sudden load applied thereto by means of progressive deformation under such load.

14. The multi-directional roof anchor of claim 1, wherein the shock absorbing portion comprises at least one suitably shaped portion of material cut or otherwise formed so that when a force is applied thereto, there is created a deformation therein in the form of a generally linear extension of the shock absorbing portion by effectively straightening or "unbending" the shock absorbing portion.

* * * * *